US008167229B2

(12) United States Patent
Enwald et al.

(10) Patent No.: US 8,167,229 B2
(45) Date of Patent: May 1, 2012

(54) REELING APPARATUS FOR FIBER WEB AND METHOD OF REELING FIBER WEB

(75) Inventors: Petri Enwald, Tuusula (FI); Teppo Kojo, Mäntsälä (FI); Per-Olof Malmqvist, Karlstad (SE); Mika-Petteri Lannes, Lappeenranta (FI); Tatu Markus Kristian Pitkänen, Nummenkylä (FI); Topi Jussi Tynkkynen, Vantaa (FI)

(73) Assignee: Metso Paper, Inc., Helsinki (FI)

( * ) Notice: Subject to any disclaimer, the term of this patent is extended or adjusted under 35 U.S.C. 154(b) by 326 days.

(21) Appl. No.: 12/595,289

(22) PCT Filed: Apr. 9, 2008

(86) PCT No.: PCT/FI2008/050172

§ 371 (c)(1), (2), (4) Date: Oct. 9, 2009

(87) PCT Pub. No.: WO2008/125723

PCT Pub. Date: Oct. 23, 2008

(65) Prior Publication Data

US 2010/0051736 A1 Mar. 4, 2010

(30) Foreign Application Priority Data

Apr. 12, 2007 (FI) ..... 20075247

(51) Int. Cl.
*B65H 35/08* (2006.01)

(52) U.S. Cl. ..... 242/527; 242/527.2; 242/615.11

(58) Field of Classification Search ..... 242/526.3, 242/527, 527.2, 532.2, 532.3, 615.11
See application file for complete search history.

(56) References Cited

U.S. PATENT DOCUMENTS

| | | | | |
|---|---|---|---|---|
| 4,014,487 | A * | 3/1977 | Reba et al. | 226/5 |
| 4,695,004 | A | 9/1987 | Grossmann et al. | |
| 5,314,132 | A * | 5/1994 | Ando et al. | 242/526.3 |
| 5,360,179 | A * | 11/1994 | Vesterinen et al. | 242/526.3 |
| 6,021,699 | A | 2/2000 | Caspar | |
| 6,241,179 | B1 * | 6/2001 | Hachiya et al. | 242/555.3 |
| 6,427,938 | B1 * | 8/2002 | Madrzak et al. | 242/526.3 |
| 6,467,720 | B1 * | 10/2002 | Madrzak et al. | 242/526.3 |
| 6,739,545 | B2 * | 5/2004 | Drefs et al. | 242/542.3 |

(Continued)

FOREIGN PATENT DOCUMENTS

CA 2227113 A1 7/1999

(Continued)

OTHER PUBLICATIONS

Written Opinion of the International Searching Authority issued in PCT/FI2008/050172.

(Continued)

*Primary Examiner* — Sang Kim
(74) *Attorney, Agent, or Firm* — Stiennon & Stiennon

(57) ABSTRACT

The present invention relates to a reeling apparatus (1) for fiber web by which fiber web may be wound to successive reels (4). The reeling apparatus has cutting devices (6) for cutting the web during a reel change, the cutting device being provided with at least one cutting head (6.2) disposed movable in a direction essentially transverse to the web direction to cut the web. A contactless web supporting arrangement (7) is been provided in operational connection with the cutting device to maintain the running of the web stable in a controlled manner during the cutting.

19 Claims, 3 Drawing Sheets

U.S. PATENT DOCUMENTS

| | | | | |
|---|---|---|---|---|
| 6,929,212 | B2 * | 8/2005 | Madrzak et al. | 242/526.2 |
| 2003/0025028 | A1 | 2/2003 | Drefs et al. | |

FOREIGN PATENT DOCUMENTS

| | | | |
|---|---|---|---|
| CA | 2265087 | A1 | 9/2000 |
| DE | 4034998 | A1 | 5/1992 |
| EP | 0089304 | A1 | 9/1983 |
| EP | 0543788 | A1 | 5/1993 |
| EP | 0744367 | A2 | 11/1996 |
| WO | 2008/125723 | A1 | 10/2008 |

OTHER PUBLICATIONS

Search Report issued in PCT/FI2008/050172.

* cited by examiner

REELING APPARATUS FOR FIBER WEB AND METHOD OF REELING FIBER WEB

CROSS REFERENCES TO RELATED APPLICATIONS

This application is a U.S. national stage application of International App. No PCT/FI2008/050172, filed Apr. 9, 2008, the disclosure of which is incorporated by reference herein, and claims priority on Finnish App. No. 20075247, filed Apr. 12, 2007.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a reeling apparatus for reeling fiber web by which fiber web may be wound to successive reels, the reeling apparatus comprising a cutting device for cutting the web during a reel change, the cutting device being provided with at least one cutting head disposed movable in a direction essentially transverse to the web running direction to cut the web.

The invention also relates to a method for reeling a fiber web, according to which the web is wound to successive reels and according to which forming of a new reel is started during the reel change by guiding the paper web to the new reel as a strip or a wedge which is narrower than the full web width and which is cut from the paper web and spread to the full width of the web by cutting the paper web before the reeling.

A reel-up is generally used for example in continuous reeling of a paper web coming from a paper machine, a coating machine or a super calender. In the reeling, the web is wound onto a reel spool and the reel being produced is pressed against the reeling cylinder over which the web runs in a certain sector and which is rotated at a peripheral speed corresponding to the speed of the web.

Prior to the completion of the reel, a new reel spool, accelerated to the corresponding peripheral speed, may be brought to a nip contact with the reeling cylinder. Immediately when the reel has reached the desired size, a reel change is performed. There are different methods of changing the reel. The conventional way is as follows. The completed reel is moved away from the reeling cylinder. Then its rotating speed starts to slow down with the result that a web loop or a web bag is created between the reeling cylinder and the completed reel. This loop is guided for example by an air jet to be wound around a new reel spool whereby it is torn off from the completed reel.

Publication EP 543788 A1 discloses a method of reeling a web in which the web is cut in the reel change by means of a water jet or jets. At first, a tip is formed in the web which is guided around an empty reel spool. After this, the tip of the web is spread and in the end cut by extending the spreading over the edges of the web.

EP publication no. 089 304 A1 discloses a continuous reeling apparatus comprising means for performing a reel change. In this solution, there are slitting blades between the reeling cylinder and the guide roll preceding it by means of which, with a transverse crosswise movement, a strip can be at first formed in the web which is turned around an empty reel spool and, subsequently, the strip is spread and the web cut. The slitting blades of the solution have been provided in a shoe plate over which the web is made to run in a gliding contact during the slitting.

A solution and method like this, however, has for example the problem that when the web is cut with mechanical blades in free run of the web, the web must be kept relatively tight in order to achieve a good cutting result. For this reason the method is not suitable at all for paper grades which require a low web tension in the reeling such as particularly tissue. Further, this kind of supporting of the web including contact causes dusting and accumulation of dust. Dropping of a large dust particle onto the web undesirably also always increases the risk of a web break. Dust is accumulated in the structures and with time decreases the operation reliability of the equipment and increases the fire risk.

Particularly when reeling tissue, the web tension before the reeling apparatus is relatively low. Then the running of the web to the reeling cylinder is typically as such not sufficiently stable for the cutting of the wire with the free web feeding in the reel change.

SUMMARY OF THE INVENTION

To solve, among others, the problems and drawbacks mentioned above, a new type of a fiber web reeling apparatus and a method for reeling fiber web have been developed. A particular object of the invention is to provide a continuously operating reeling apparatus and a method for reeling tissue.

An object of the invention is a continuous reeling apparatus for fiber web, by means of which fiber web may be wound to successive reel, the reeling apparatus comprising a web cutting device for cutting the web in the reel change, the web cutting device being provided with at least one cutting head movable essentially in the transverse direction relative to the running direction of the web, the cutting head being provided to cut the web during the free run of the web before the reeling cylinder. It is characteristic to the continuous fiber web reeling apparatus according to the invention that a contactless support arrangement in operational communication with the cutting head has been provided for the web, for maintaining the running of the web stable in a controlled manner during the cutting.

According to a preferred embodiment of the invention a web supporting system has been arranged in connection with the cutting. This gives among other things the advantage that while the web is supported the support arrangement keeps the web reliably at a constant distance from the cutting head. With this embodiment, also the utilization of space in the vicinity of the reeling cylinder is optimized. Preferably the cutting head has been arranged to cut the web in the area of its free run with the result that the cutting head need not be for example in connection with the reeling cylinder which improves the overall use of space in the area of the reeling apparatus.

The invention also relates to a method of reeling a fiber web according to which web is wound continuously to successive reels and according to which the forming of a new reel is started by guiding the paper web to a new reel as a narrower strip than the full width of web, the strip being cut from the paper web and spread to the full width of the web by cutting the paper web before the reeling in the area of the free run of the web. It is characteristic to the method among others that the web is supported during the cutting in an essentially contactless way at least in the cutting range of the cutting device. The method of the invention is preferably carried out so that the web tension in the cutting area is less than 500 N/m, preferably less than 250 N/m.

The object of an embodiment of the invention is a continuously operating reeling apparatus for tissue web.

BRIEF DESCRIPTION OF THE DRAWINGS

In the following the invention and its operation will be described with reference to the accompanying schematic drawings.

DESCRIPTION OF THE PREFERRED EMBODIMENTS

Figure 1:
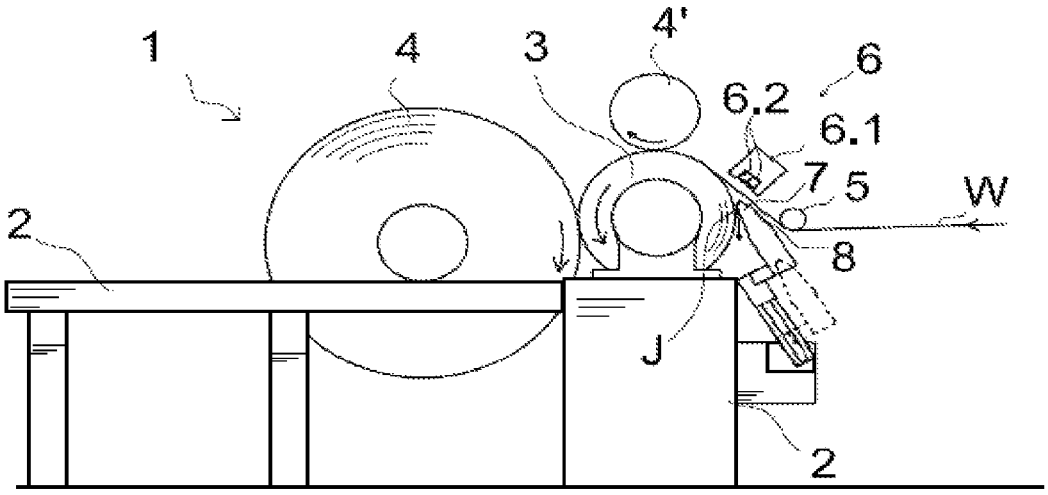
FIG. 1 illustrates a side view of an embodiment of the invention.

In connection with the following figures of the invention, a continuously operating fiber web reeling apparatus 1 according to a preferred embodiment of the invention has been disclosed. The apparatus comprises a reeling cylinder 3 supported by a frame structure 2, via which cylinder web W is guided to a reel 4 being formed. Web W is produced in a paper manufacturing apparatus preceding the reeling apparatus 1 and it is brought to the reeling cylinder 3 via a guide roll 5. Typically, the guide roll is a so-called spreading roll creating an appropriate transverse web tension when the web arrives to the reeling cylinder. In connection with the guide roll 5 and the reeling cylinder 3, there is a web cutting device 6 for cutting the web during a reel change. In operational connection with the cutting device 6 there is a contactless web support system 7 which in the embodiment of FIG. 1 is separate from the cutting device.

The cutting device 6 includes a beam or a support structure 6.1 extending over the web in transverse direction, in support of which the cutting heads 6.2 are disposed movably to the guide of the support structure (not illustrated). There are preferably two cutting heads 6.2, whereby a wedge-shaped tip widening from the center area may be cut to the web which during the reel change is guided around an empty reeling shaft 4'. The wedge-shaped tip is created so that, when the cutting has started, the cutting heads pass by each other while they move towards the edges of the web. The shape of the tip may be influenced by changing the speed of the cutting heads. The cutting device has been provided in the area of the free run of the web, in other words between the guide roll 5 and the reeling cylinder 3 where the web runs without a separate mechanical support such as a wire.

There is a contactless support arrangement 7 for the web in operational connection with the cutting device 6, which provides a supporting effect for the web by appropriately directed blow jets. Air flow blown from air nozzles creates a suction effect to the web which thus stabilizes the web to run along a desired path. Preferably the design of the nozzles is such that the air jet is directed away from the web at least or at the latest after the nozzle slot by means of, for example, an essentially smooth guide surface provided as continuation of the nozzle slot, utilizing the so-called Coanda effect. The jets are created by means of slot-like air flow nozzles J. In the embodiment of FIG. 1 the jets are directed away from the nip of the web and the reeling cylinder. By applying the invention so that support of a part of the width of the web is effected, it provides to some extent an advantageous effect. However, the support arrangement in FIG. 1 is such that its influence extends over the whole width of the web. In this solution the running of the web is well controlled over the whole width and also the cutting takes place reliably at a very low web tension for example when reeling tissue with a grammage of less than 30 g/m$^2$. The support arrangement also includes a support surface 8 and conditions stabilizing the running of the web between the support surface and the web W are created by the jets. The support system is designed to be moved along support structures so that it may be pulled away from the vicinity of the web and the reeling cylinder if necessary, which has been illustrated in the FIG. 1 by broken lines.

The apparatus described above works so that when the reel 4 being formed has reached the desired size, a reel change is performed. A new reel spool 4' accelerated to the web speed is brought to contact with the reeling cylinder. The cutting heads 6.2 have been brought to the center area of the web, preferably both slightly exceeding the center line. When the cutting is started the cutting heads are moved towards the edges of the web, whereby a wedge-like tip is formed in the web. This tip is guided around the empty reel spool 4', the wedge is cut wider past the edges whereby it is cut loose and reeling to the new reeling shaft 4' is started. This may be performed in the actual reeling station on the rails of the frame structure 2 presupposing that the reel being formed has at first been moved further away from the reeling cylinder, or in the position illustrated in FIG. 1. The contactless support system 7 is activated at least during the cutting of the web and thus during the reel change whereby it at the same time stabilizes the running of the web and keeps it essentially at a constant distance from the cutting head and eliminates fluttering of the web and bag formation in the closing nip of the reeling cylinder and the web.

Figure 2:
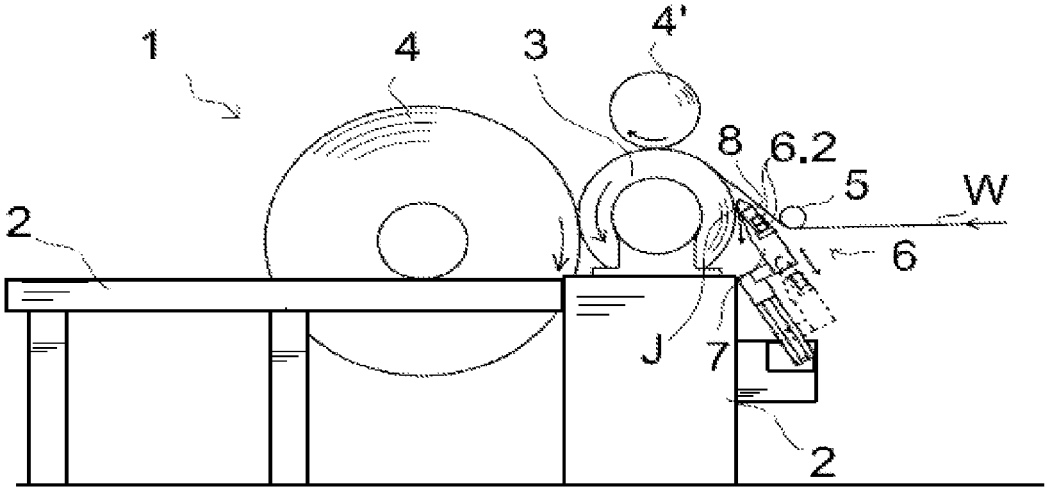
FIG. 2 illustrates another embodiment of the invention.
Figure 1A:
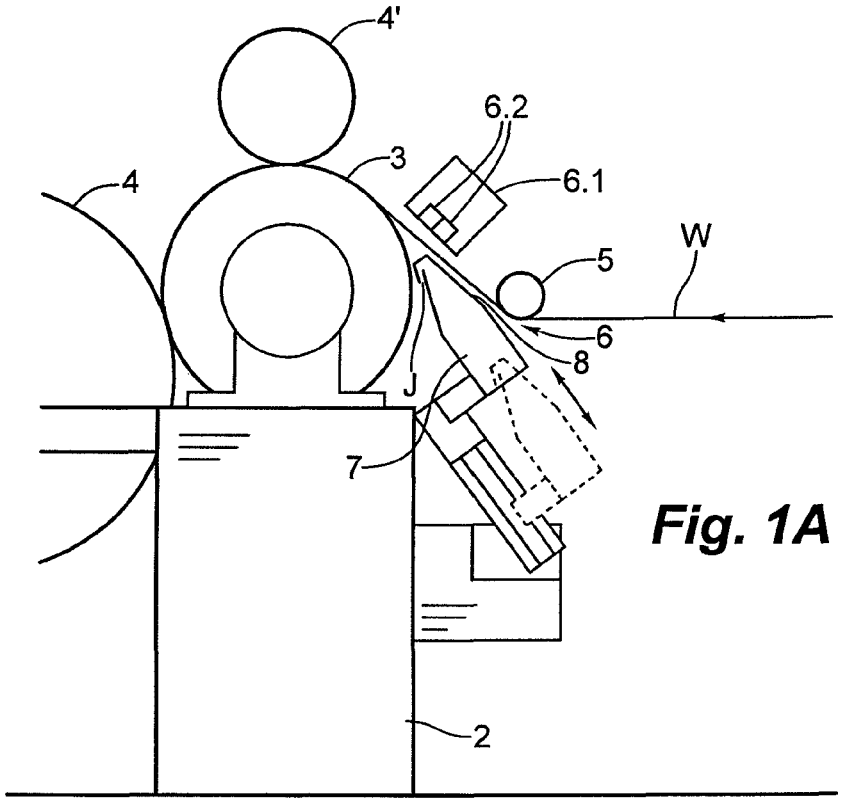
FIG. 1*a* shows an enlarged and more detailed view of FIG. 1.
Figure 2A:
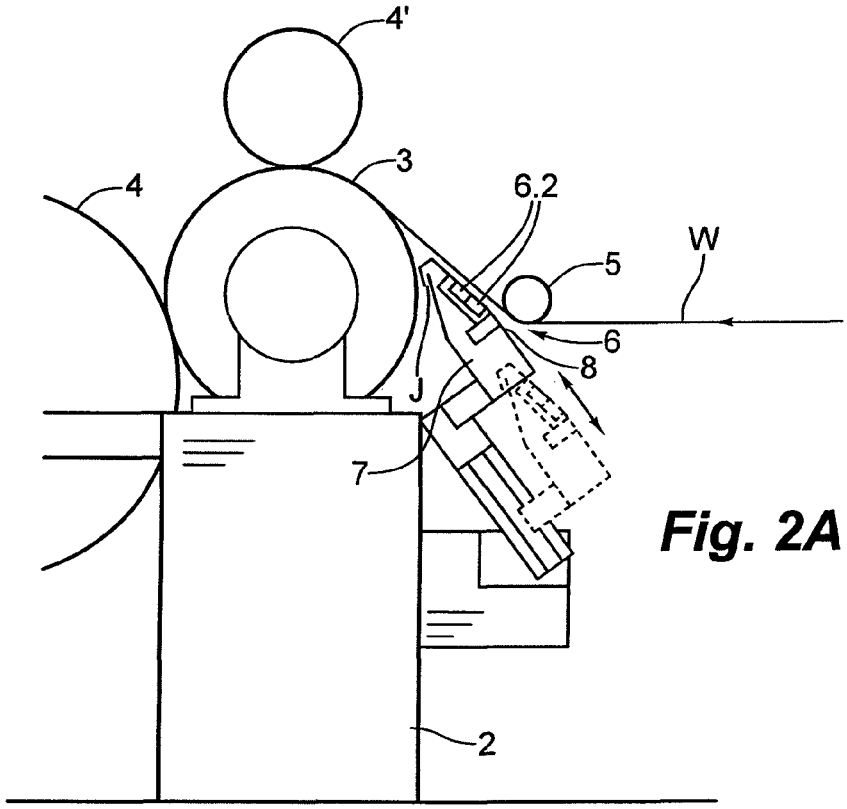
FIG. 2*a* shows an enlarged and more detailed view of FIG. 2.

Another embodiment of the invention is illustrated in FIG. 2. The same reference numbers have been used here as for the elements in FIG. 1, where applicable. Here the cutting device has been integrated with the support arrangement 7 of the web. The embodiment illustrated in the FIG. 2 is a very advantageous solution for example because due to the shared set of support beams space remains in the vicinity of the reeling apparatus for other use. Further, combining the cutting device and the web support system to one and the same unit allows optimizing the air jets and the structure of the support system by taking into account explicitly its influence in the cutting action. Further, this solution also makes it possible to pressurize the cutting device by means of the air blowing of the support arrangement, and thus no impurities or dust can get into it. By the support arrangement of the invention, the dust control can be paid attention to also more thoroughly, and dust removal devices can be integrated to the apparatus.

The method of the invention is preferably carried out so that the web tension in the cutting area is less than 500 N/m, preferably less than 250 N/m.

Also in the embodiment of FIG. 2 the apparatus (cutting device 6—web supporting arrangement 7) is movable further away from the moving web W. As the apparatus is here under the web, maintenance work can be performed on machine level and no separate service platforms are needed across the machine and above the web. This is a remarkable advantage as structures above the web always increase the risk of problems; for example possible condensation of water from moist air to the structures and dripping of water onto the web, and accumulation of dust to the structures discussed.

The web support system keeps the web stable and supported when it arrives to the reeling cylinder, whereby the cutting can be performed further away from the reeling cylinder under the web. In this position there is also more space outside the edges of the web which allows increasing the movement range of the cutting heads outside the web. The cutting heads require a certain distance to slow down their movement and in this embodiment the slowing down can be done mainly in the area outside the edges of the web. Then the wedge to be cut at the edges of the web during the cutting operation may be made relatively steep and thus no essential strips remain at the edges of the reel. These kind of strips are easily broken during the deceleration of a completed reel whereby paper shreds produced are scattered in the surroundings and thus also inside the new reel.

The cutting heads 6.2 preferably comprise a water nozzle and apparatus for feeding high-pressure water. Cutting the web with water is preferable particularly with tissue as it is an easily dusting paper grade. The cutting head may also be used in cutting the web in the longitudinal direction at other times than during a reel change.

Figure 3A:
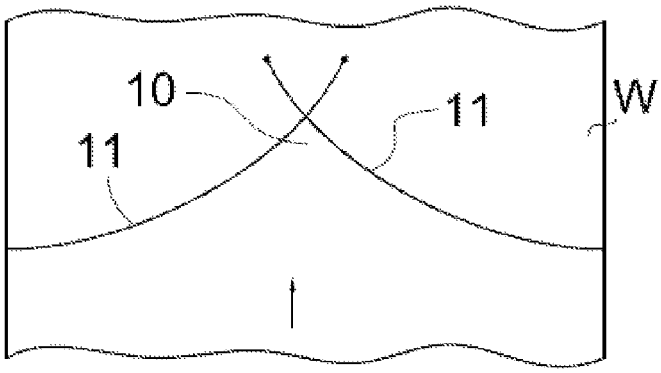
FIGS. 3*a*-3*c* illustrate various cutting lines applicable in the method of the invention.
Figure 3B:
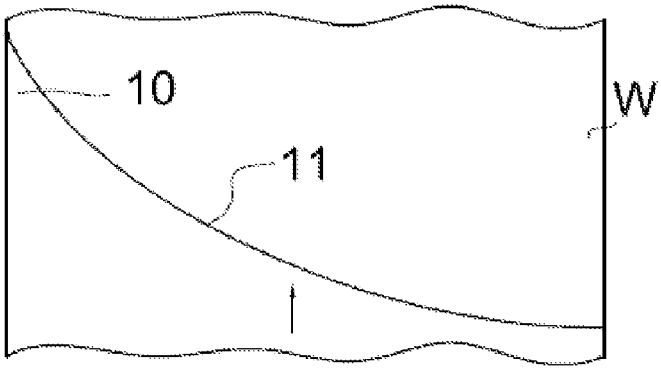
Figure 3C:
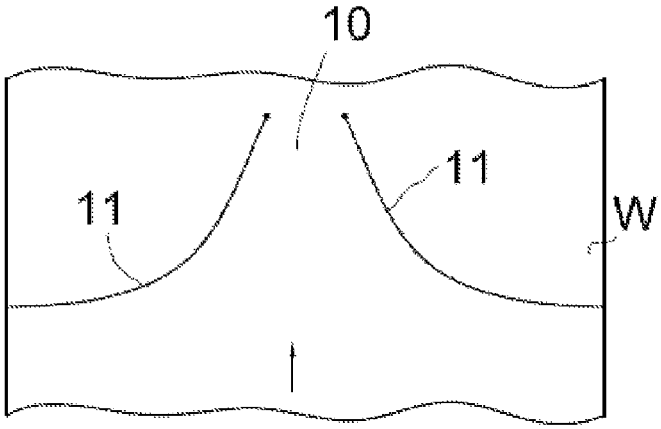

FIGS. 3*a* and 3*c* illustrate the cutting path 11 in the web W, when two separate cutting heads are used. An arrow indicates the running direction of the web. The cutting may be started by forming a wedge-like tip 10 in the web and spreading it from the center portion of the web towards its edges. The tip can be cut loose as illustrated in FIG. 3*a* by guiding the cutting heads to pass each other. Alternatively, the wedge-like portion may be left uncut totally off at the center as illustrated in FIG. 3*c*. Then the final detaching of the wedge portion is carried out for example by a separate blowing (not illustrated). As illustrated in FIG. 3*b*, the cutting may be carried out with one cutting head and along a movement path 11, which forms a wedge-like tip 10 at one of the edges of the web W.

As can be understood from the above description, a continuous fiber web reeling apparatus and method have been developed, which eliminate a remarkable part of the drawbacks of the prior art. However, it should be noted that only a few preferred embodiments of the invention have been described above. Thus, it is clear that the invention is not limited to the embodiments described above but it may be modified in many ways within the scope of protection defined by the appended patent claims. In some applications the support arrangement may be carried out as a passive solution, in which the effect is achieved without air blowing by means of a suitable surface geometry in relation to the web and the rest of the reeling apparatus components.

We claim:

1. A reel-up for forming successive reels of a fiber web which travels in a machine direction, comprising:

a reeling drum;

a web cutting device arranged for cutting the web during a reel change, the cutting device having at least one cutting head mounted for movement in a direction essentially transverse to the machine direction to cut the web as it extends in a free run of the web adjacent to and preceding the reeling drum;

a contactless web support system in operational contact with the cutting device, provided to maintain the running of the web stable in a controlled manner during the cutting operation;

wherein the web support system includes a blow box provided with air blow nozzles arranged to direct an air jet away from the web, the nozzles arranged to form the jet of air between the blow box and the reeling drum to create a suction effect between the reeling drum, the blow box and the web so that the web is stabilized to run along and over an upwardly facing support surface formed by the blow box; and wherein the web cutting device is in operational connection with the web support system.

2. The reel-up of claim 1 wherein the reeling apparatus includes a reeling cylinder and a web guide roll preceding it in the running direction of the web, and wherein the cutting device is disposed to cut the web between the reeling cylinder and the guide roll.

3. The reel-up of claim 1 wherein the air blow nozzles are formed by a slot, and the slot and the blow box are arranged so that air blows in a direction at least after the nozzle slot essentially away from the web.

4. The reel-up of claim 3, wherein the web support system extends to the free run of the web beyond the cutting head in the machine direction.

5. The reel-up of claim 1 wherein the cutting device is mounted to the contactless web support system.

6. The reel-up of claim 1 wherein the cutting head includes a water nozzle connected to a source of high-pressure water.

7. A method of reeling a fiber web, comprising the steps of:

winding the fiber web in a machine direction into successive reels of a first width by way of a reeling cylinder and while supported by the reeling cylinder;

cutting the fiber web with a cutting device immediately before the reeling cylinder in a free run leading to the reeling cylinder, and prior to the fiber web forming part of one of said successive reels, to form a strip or a wedge narrower than the first width of the web;

guiding the web to a new reel by guiding the said strip or wedge to the new reel, and spreading said strip or wedge to the first width of the web;

supporting the web during the cutting essentially in a contactless manner at least in a cutting area of the cutting device and immediately before the reeling cylinder; and wherein the web is supported in the cutting area of the cutting device and immediately before the reeling cylinder by blowing air through air blow nozzles to direct an air jet away from the web, between a blow box and the reeling drum and creating a suction effect between the reeling drum, the blow box and the web so that the web is stabilized and runs along and over an upwardly facing support surface formed by the blow box.

8. The method of claim 7, wherein the strip or wedge is spread to the full width of the web by cutting the web prior to the web reaching the reeling cylinder and in the free run of the web.

9. The method of claim 7, wherein the tension of the fiber web is less than 500 N/m.

10. The method of claim 7, wherein the tension of the fiber web is less than 250 N/m.

11. The method of claim 7, wherein the supporting of the web during the cutting in the cutting area and immediately before the reeling cylinder is by an effect which is created by blowing air.

12. The method of claim 7, wherein the cutting and the supporting of the web take place on the same side of the web, so that the web is supported from one side only.

13. The method of claim 12, wherein the cutting and the supporting of the web take place under the web, so that the web is supported from under the web only.

14. The method of claim 7, wherein the cutting and the supporting of the web take place on different sides of the web.

15. The method of claim 7, wherein the web is supported in the machine direction essentially from a point where cutting is preformed to the reeling cylinder.

16. The method of claim 7, wherein the web is a tissue web.

17. A reel-up for forming successive reels of a fiber web, comprising:

a frame structure;

a reeling drum mounted to the frame structure;

a fiber web arranged for travel in a machine direction;

a guide roll position in an upstream direction with respect to the reeling drum to direct the fiber web along a free run leading from the guide roll to a closing nip with the reeling drum;

a reel or reeling shaft engaged with the reeling drum in web receiving relation;

wherein the web extends from the guide roll to the closing nip and along the reeling drum to the reel or reeling shaft;

a blow box provided with air blow nozzles mounted only below the fiber web between the guide roll and the closing nip, the air blow nozzles arranged to direct an air jet away from the web, the nozzles arranged to form the jet of air between the blow box and the reeling drum to create a suction effect between the reeling drum, the blow box and the web so that the web is stabilized to run along and over an upwardly facing support surface formed by the blow box so as to maintain the running of the web stable in a controlled manner during a cutting operation; and a web cutting device mounted to the blow box and arranged for cutting the web during a reel change, the cutting device positioned below the fiber web, the cutting device having at least one cutting head mounted for movement in a direction essentially transverse to the web direction so as to cut the web as it extends in the free run to the reeling drum.

18. The reel-up of claim 17 wherein the air blow nozzles are formed by a slot such that an air jet created by the slot is directed away from the web after the slot by a smooth guide surface forming a continuation of the nozzle slot, such that a Coanda effect is produced.

19. The reel-up of claim 17 wherein the fiber web is a tissue web.

* * * * *